US006362612B1

(12) United States Patent
Harris

(10) Patent No.: US 6,362,612 B1
(45) Date of Patent: Mar. 26, 2002

(54) BANDGAP VOLTAGE REFERENCE CIRCUIT

(76) Inventor: Larry L. Harris, 4405 Knob Oak La., Austin, TX (US) 78725

( * ) Notice: Subject to any disclaimer, the term of this patent is extended or adjusted under 35 U.S.C. 154(b) by 0 days.

(21) Appl. No.: 09/771,517

(22) Filed: Jan. 23, 2001

(51) Int. Cl.[7] ..... G05F 3/04; G05F 3/16

(52) U.S. Cl. ..... 323/312; 323/313; 323/314; 327/538

(58) Field of Search ..... 323/312, 313, 323/314, 315, 316, 280, 281; 327/538, 539, 535

(56) References Cited

U.S. PATENT DOCUMENTS

| | | | | | |
|---|---|---|---|---|---|
| 3,617,859 | A | | 11/1971 | Dobkin et al. | |
| 4,287,439 | A | | 9/1981 | Leuschner | |
| 4,317,054 | A | | 2/1982 | Caruso et al. | |
| 4,525,663 | A | * | 6/1985 | Henry | 323/280 |
| 4,588,941 | A | | 5/1986 | Kerth et al. | |
| 4,622,512 | A | | 11/1986 | Brokaw | |
| 4,795,961 | A | | 1/1989 | Neidorff | |
| 4,849,684 | A | | 7/1989 | Sonntag et al. | |
| 4,896,094 | A | * | 1/1990 | Greaves et al. | 323/314 |
| 5,126,653 | A | | 6/1992 | Ganesan et al. | |
| 5,144,223 | A | | 9/1992 | Gillingham | |
| 5,144,523 | A | * | 9/1992 | Gillingham | 323/313 |
| 5,619,163 | A | * | 4/1997 | Koo | 327/539 |
| 6,281,743 | B1 | * | 9/2001 | Doyle | 327/539 |

OTHER PUBLICATIONS

Grebene, Alan B., Bipolar and MOS Analog Integrated Circuit Design, 1984, pp. 206–209, John Wiley & Sons, Inc., United States. No date available.

* cited by examiner

*Primary Examiner*—Rajnikant B. Patel
(74) *Attorney, Agent, or Firm*—Thompson & Knight, L.L.P.; H. Lisa Calico

(57) ABSTRACT

An improved bandgap voltage reference circuit for providing a stable reference output voltage, useful in circuits associated with power supply voltage operations as low as approximately 1.3 Volts. The $\Delta V_{BE}$ generator is comprised of a pair of bipolar transistors operating at different current densities. Resistors in series with the transistors, in conjunction with an operational amplifier and current sources, produce a larger Voltage drop proportional to the $\Delta V_{BE}$ of the transistors. Output from the operational amplifier is connected to the base of a third bipolar transistor. The third bipolar transistor is provided as the bandgap voltage output device.

26 Claims, 3 Drawing Sheets

BANDGAP VOLTAGE REFERENCE CIRCUIT

TECHNICAL FIELD OF THE INVENTION

The present invention relates in general to solid state voltage reference elements and, in particular, to bandgap voltage reference elements, which can operate from a low supply voltage.

BACKGROUND OF THE INVENTION

Without limiting the scope of the invention, its background is described in connection with the design of bias circuits for integrated circuits using CMOS technology. It should be appreciated by one skilled in the art that the principles of the present invention may be implemented in a wide variety of applications.

A bandgap reference circuit 10 known in the prior art is shown in FIG. 1A. Bandgap reference circuit 10 generally comprises bipolar transistors 12 ($Q_1$) and 14 ($Q_2$), resistors 16 ($R_2$), 18 ($R_1$), and 20 ($R_1$), operational amplifier 22, and an offset voltage source 24. ($R_1$ represents the resistance of either resistor 18 or resistor 20.) Under ideal situations, the voltage provided by the offset voltage source 24 is zero volts. In addition, the base terminal and the collector terminal of bipolar transistors 12 ($Q_1$) and 14 ($Q_2$) are shown connected to a power supply voltage terminal 26 ($V_{SS}$), which is typically zero volts.

The equation describing the bandgap output voltage $V_{BG}$ of the circuit 10 in FIG. 1A is shown below:

$$V_{BG}=V_{BE}+(R_1/R_2)\cdot V_{BE}, \quad (1)$$

where $V_{BE}$ is the base-to-emitter voltage across bipolar transistor 12 ($Q_1$), and $\Delta V_{BE}$ is the difference of the base-to-emitter voltages between bipolar transistor 12 ($Q_1$) and bipolar transistor 14 ($Q_2$), which are operated at different current densities. $V_{BE}$ has a negative temperature coefficient, while $\Delta V_{BE}$ has a positive temperature coefficient. The $\Delta V_{BE}$ voltage is imposed across resistor 16 ($R_2$). An image of the current flowing through resistor 16 ($R_2$), which is $\Delta V_{BE}/R_2$, is forced to flow through resistor 18 ($R_1$). This gives rise to the term $(R_1/R_2)\cdot\Delta V_{BE}$.

By properly selecting the value of $(R_1/R_2)$, the magnitude of the positive temperature coefficient term can be scaled and then added to the negative temperature coefficient term to substantially cancel the temperature effects. This zero, or extremely low, temperature coefficient output voltage is known as the bandgap output voltage.

A bandgap reference circuit can therefore provide a stable output voltage with respect to temperature. Furthermore, a bandgap reference circuit, such as the one shown in FIG. 1A, can also be designed such that when the supply voltage exceeds a minimum voltage level for proper biasing, the bandgap voltage reference will have a very good power supply rejection ratio. These characteristics makes the bandgap reference circuit a desirable candidate for use as a voltage reference for integrated circuits such as analog-to-digital converters, digital-to-analog converters, and bias current generators. In general, a bandgap voltage reference may be used in analog circuits or mixed-signal circuits to generate a stable, temperature-independent voltage reference.

It has been described in the prior art that it is very desirable to generate as large as possible of a $\Delta V_{BE}$ term, which is the voltage drop across resistor $R_2$, in order to make the term $(R_1/R_2)$ as small as possible. The $(R_1/R_2)$ term increases any non-ideal conditions associated with the generation of $\Delta V_{BE}$, as well as any noise voltage associated with $R_2$.

In previous attempts to increase the $\Delta V_{BE}$ term, a stack of two $V_{BE}$ diode arrays has been used. FIG. 1B shows a circuit in the prior art utilizing this approach. The circuit in FIG. 1B has a diode stack containing two diodes. The voltage difference between the two stacked diodes yields a larger $\Delta V_{BE}$ term. This will yield a $\Delta V_{BE}$ term that is twice as large as the $\Delta V_{BE}$ term generated in the circuit 10 shown in FIG. 1A.

However, the addition of stacked diode arrays increases the minimum supply voltage required for proper operation, as well as increasing the overall physical size of the bandgap voltage reference circuit. For a sub-micron CMOS process, the number of diodes in a stack is limited to a stack of two diodes due to the maximum allowed supply voltage, which is typically 3.6 volts. Therefore, the usefulness of stacked diode arrays to minimize noise associated with the $(R_1/R_2)$ term is limited.

In a sub-micron CMOS process, using a bandgap voltage reference circuit as the voltage reference of a high resolution (i.e., greater than 12 bit resolution) analog-to-digital converter or digital-to-analog converter, the noise present at the output of the prior art bandgap voltage circuit is very large and must be filtered out. This filtering is typically accomplished with a large value capacitor, which is external to the integrated circuit. Electrical connection to this external capacitor is achieved with bond wires and package leads. The problem of electromagnetic coupling to the bond wires and package leads limit the usefulness of external capacitors as filter elements. Thus, it is desirable to have a bandgap voltage reference circuit with low noise so that an external capacitor is not required.

SUMMARY OF THE INVENTION

From the foregoing, it can be appreciated that a need exists for a voltage reference circuit that overcomes the problems in the prior art. It is desirable that such a voltage reference circuit has an output voltage that is not subject to substantial variations due to temperature changes. It is further desirable that such a voltage reference circuit has a lower output noise voltage than the prior art. It is believed that the features of the present invention described herein solve and address the foregoing problems and limitations.

In accordance with the present invention, a bandgap voltage reference circuit is provided that is associated with low power supply voltage operation. The value of the power supply voltage can be as low as approximately 1.3 volts, which makes the inventive bandgap voltage reference topology suitable for sub-micron CMOS processes wherein supply voltages may typically range from approximately 1.8 volts to approximately 3.6 volts.

An improved bandgap voltage reference circuit is described herein for providing a stable reference output voltage. In accordance with a preferred embodiment of the present invention, the improved bandgap voltage reference circuit comprises a pair of bipolar transistors connected in common collector configuration and operating at different emitter current densities. The circuit further comprises resistors connected in series with each of the bipolar transistor emitters for establishing a voltage drop. The circuit further comprises a pair of CMOS transistors connected in common source configuration and functioning as current sources, wherein the source terminals are connected to a positive supply voltage, and the drain terminals are connected with the resistors. The circuit further comprises an operational amplifier wherein the output terminal is connected to the gates of the CMOS transistors.

The circuit also includes a CMOS transistor operating as a positive temperature coefficient current source, wherein the gate is connected to the output of the operational amplifier, and the source is connected to a positive voltage supply. Another CMOS transistor is included, which operates as a current source, wherein the gate is connected to the output of the operational amplifier, and the source is connected to the positive voltage supply. The circuit further comprises another bipolar transistor for serving as the output device of the bandgap voltage generator, wherein the base is connected to the drain of the CMOS transistor operating as a current source.

The circuit of the present invention may also include a base compensation circuit for canceling any errors introduced into the circuit by the base current of the output bipolar transistor. The circuit of the present invention may further include a feedback voltage adjustment circuit comprising resistive elements and switch elements controlled by digital logic.

A preferred method of providing a bandgap voltage reference is also disclosed herein. The inventive method comprises the steps of operating a pair of bipolar transistors at different emitter current densities, providing one or more resistive elements in series with the pair of bipolar transistors for establishing a voltage drop, operating a pair of CMOS transistors as current sources, configuring an operational amplifier for providing a positive temperature coefficient current source, providing a control voltage for the positive temperature coefficient current source, providing a positive temperature coefficient voltage source, and providing a third bipolar transistor as a bandgap voltage output device. The method may further comprise the step of offsetting error introduced by the base current of the bandgap voltage output device. The method may further comprise the step of adjusting the value of the resistance of the resistive elements.

For a more complete understanding of the present invention, including its features and advantages, reference is now made to the following detailed description, taken in conjunction with the accompanying drawings.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 2:
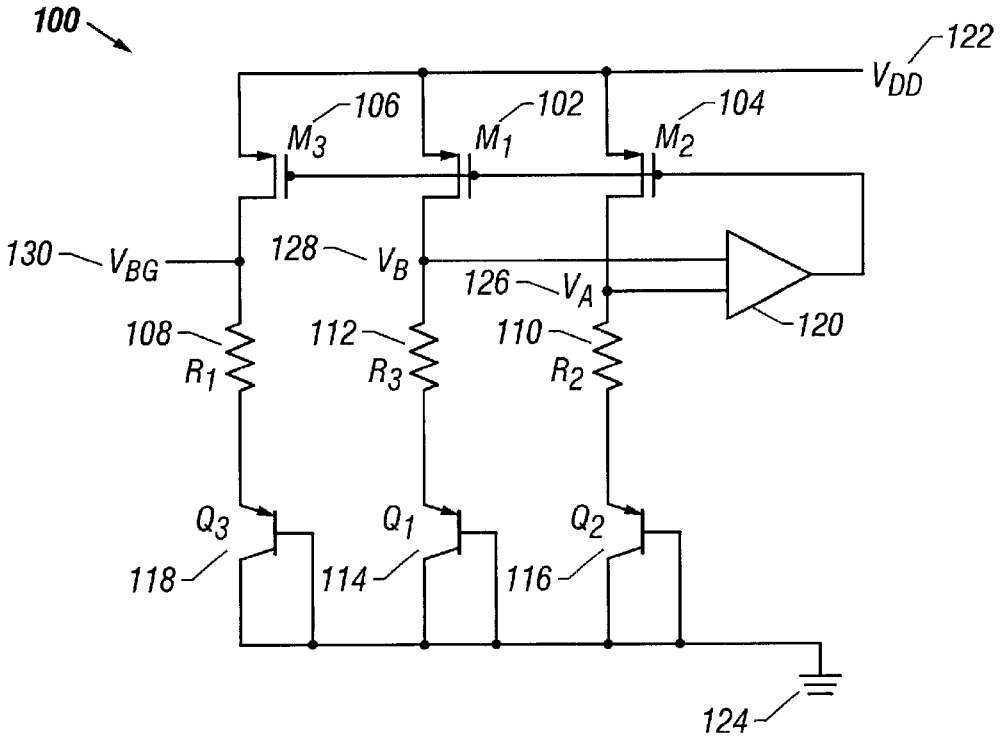
FIG. 2 depicts a schematic diagram of a bandgap voltage reference circuit in accordance with an embodiment of the present invention.
Figure 3:
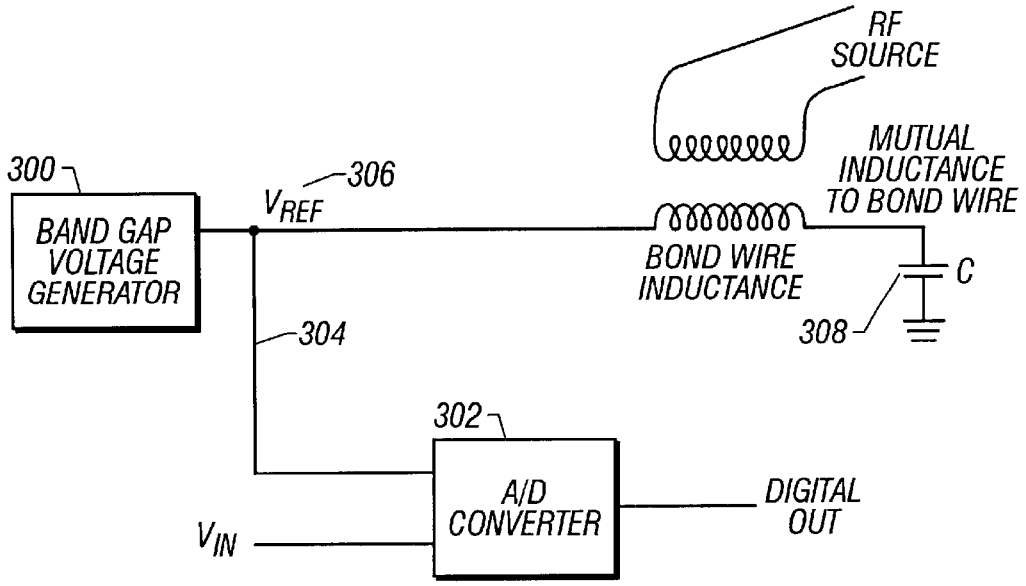
FIG. 3 depicts a block diagram of a prior art bandgap voltage reference circuit in conjunction with an external filter capacitor used as a reference for an analog-to-digital converter.

Reference is now made to FIG. 2, which depicts a schematic diagram of an exemplary bandgap voltage reference circuit 100 in accordance with the present invention. Circuit 100 comprises CMOS (complementary metal-oxide semiconductor) transistor 102 ($M_1$), CMOS transistor 104 ($M_2$), and CMOS transistor 106 ($M_3$), resistor 108 ($R_1$), resistor 110 ($R_2$) and resistor 112 ($R_3$), bipolar transistor 114 ($Q_1$), bipolar transistor 116 ($Q_2$), and bipolar transistor 118 ($Q_3$), and a feedback operational-amplifier 120. Circuit 100 includes a terminal to a supply voltage 122 ($V_{DD}$), and a reference to ground 124.

The circuit 100 shown in FIG. 2 is suitable for a standard all CMOS process. In a standard CMOS only process, PNP bipolar transistors may be formed by $p^+$ diffusion area inside an n-well area. The $p^+$ diffusion area inside of an n-well area creates the emitter; the n-well creates the base; and the substrate creates the collector.

Circuit 100 can also be manufactured in a BiCMOS process. In addition, if all PMOS (p-channel metal-oxide-semiconductor) transistors are replaced with PNP bipolar transistors whose collectors are not electrically connected to the substrate, then circuit 100 could also be manufactured in a pure PNP bipolar process. Thus, while CMOS transistor 102 ($M_1$), CMOS transistor 104 ($M_2$), and CMOS transistor 106 ($M_3$) are shown in FIG. 2 as PMOS transistors, and bipolar transistor 114 ($Q_1$), bipolar transistor 116 ($Q_2$) and bipolar transistor 118 ($Q_3$) are depicted as PNP bipolar transistors, it should be appreciated by one skilled in the art that the principles of the present invention may be implemented using other types of semiconductor processes.

In addition, the circuit 100 can achieve a large voltage drop across resistor 110 ($R_2$) without the need of stacked diode arrays. The circuit of the present invention, however, may be implemented with or without stacked diode arrays.

The operational-amplifier 120 has sufficient gain such that the voltage at node A designated as 126 ($V_A$) and the voltage at node B designated as 128 ($V_B$) are assumed to be equal. Transistor 102 ($M_1$) and transistor 104 ($M_2$) are also assumed to have equal current flowing through them. (This assumption is used to simply the following equations. In practice, the currents flowing through transistor 102 ($M_1$) and transistor 104 ($M_2$) need only be linearly related to each other.)

Therefore, we have:

$$V_A=V_B \tag{2}$$

Referring to FIG. 2, the voltage at node A 126 ($V_A$ and the voltage at node B 128 ($V_B$) are given as follows:

$$V_A=V_{BE2}+V_{R2} \tag{3}$$

and $$V_B=V_{BE1}+V_{R3} \tag{4}$$

where $V_{BE2}$ is the base-emitter voltage across transistor 116 ($Q_2$), $V_{BE1}$ is the base-emitter voltage across transistor 114 ($Q_1$), $V_{R2}$ is the voltage across resistor 110 ($R_2$), and $VR_3$ is the voltage across resistor 112 ($R_3$).

Combining Eqs. 2, 3, and 4 yields:

$$V_A=V_{BE2}+V_{R2}=V_{BE1}+V_{R3}. \tag{5}$$

FIG. 2 illustrates transistor 116 ($Q_2$) as eight times larger than transistor 114 ($Q_1$). Therefore, $V_{BE1}\neq V_{BE2}$.

Rearranging Eq. 5 yields:

$$V_{R2}=V_{BE1}+V_{R3}-V_{BE2}. \tag{6}$$

Since transistor 102 ($M_1$) and transistor 104 ($M_2$) are also assumed to have equal current flowing through them, it follows that:

$$I_{R2}=I_{M2}=I_{M1}=I_{R2}. \quad (7)$$

The current $I_{R2}$ flowing through resistor 110 ($R_2$) can be shown as:

$$I_{R2}=V_{R2}/R_2. \quad (8)$$

The voltage $V_{R3}$ across resistor 112 ($R_3$) can be shown as:

$$V_{R3}=I_{R2}\cdot R_3=(VR_2/R_2)\cdot R_3. \quad (9)$$

Therefore, combining Eqs. 6 and 9 results in the following equation:

$$V_{R2}=V_{BE1}-V_{BE2}+(V_{R2}\cdot(R_3/R_2)). \quad (10)$$

Solving Eq. 10 for $V_{R2}$ results in the following equation:

$$V_{R2}=(V_{BE1}-V_{BE2})/(1-(R_3/R_2))=\Delta V_{BE}/(1-(R_3/R_2)). \quad (11)$$

From Eq. 11, it is shown that the voltage across resistor 110 ($R_2$) is a $\Delta V_{BE}$ term multiplied by a factor of $1/(1-(R_3/R_2))$. The term $1/(1-(R_3/_{R2}))$ can be made very large by proper selection of resistors 112 ($R_3$) and 110 ($R_2$).

As shown in FIG. 2, the bandgap voltage 130 ($V_{BG}$) is given by the following:

$$V_{BG}=V_{R1}+V_{BE3}. \quad (12)$$

Again, assuming that $I_{M1}=I_{M3}$, it follows that:

$$V_{R1}=(V_{R2}/R_2)\cdot R_1=\{(\Delta V_{BE}/(1-(R_3/R_2)))\cdot(R_1/R_2)\}, \quad (13)$$

and $$V_{BG}=V_{BE3}+\{(\Delta V_{BE}/(1-(R_3R_2)))\cdot(R_1/R_2)\}. \quad (14)$$

For simplicity, the foregoing assumes that transistor 102 ($M_1$), transistor 104 ($M_2$), and transistor 106 ($M_3$) all have the same value of current flowing through them; however, the currents flowing through transistor 102 ($M_1$), transistor 104 ($M_2$), and transistor 106 ($M_3$) do not have to be of equal value. Rather, these currents only need to be linearly related to each other. When the currents of transistor 102 ($M_1$), transistor 104 ($M_2$), and transistor 106 ($M_3$) are not equal to each other, but instead are linearly related to each other, the preceding analysis must be modified by the current ratios of transistor 102 ($M_1$) to transistor 104 ($M_2$), as well as the current ratios of transistor 102 ($M_1$) to transistor 106 ($M_3$). One skilled in the art should be able to modify Eq. 14 to include such current ratios.

Figure 1A:
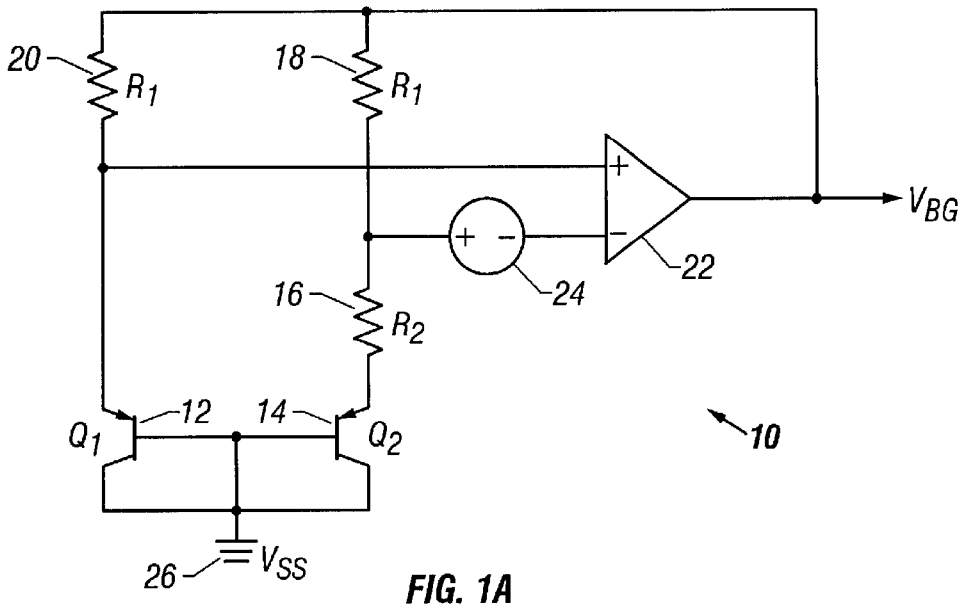
FIG. 1A (Prior Art)
FIG. 1A depicts a schematic diagram of a prior art bandgap voltage reference circuit.
Figure 1B:
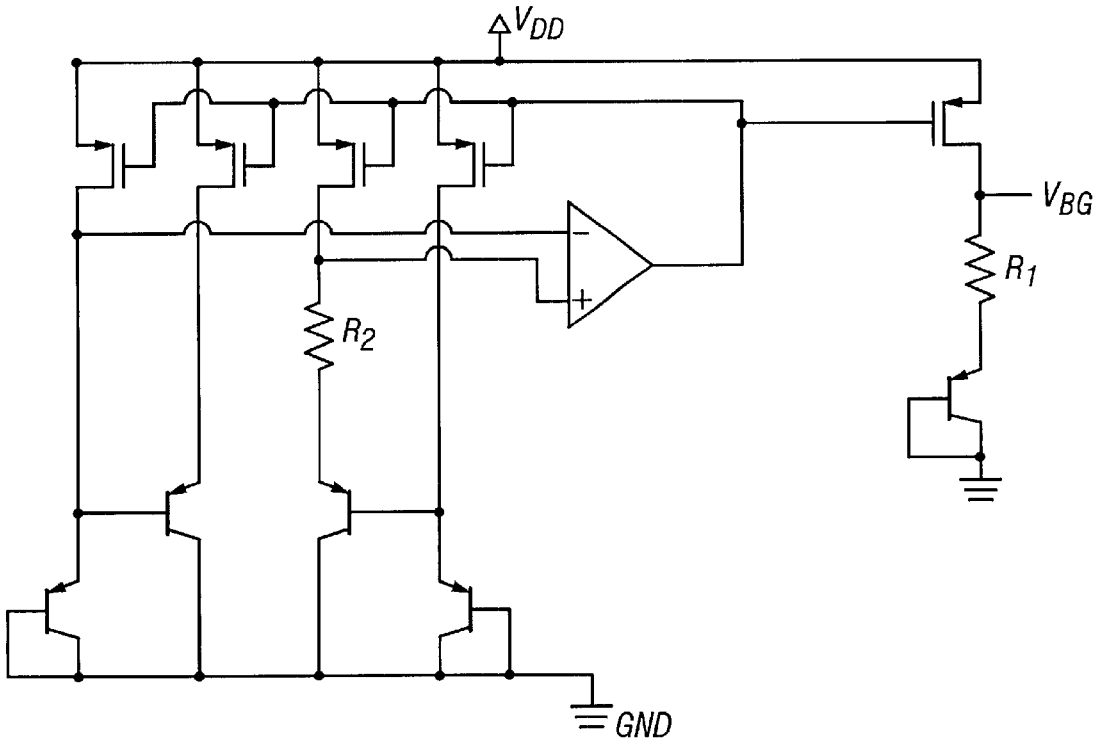
FIG. 1B (Prior Art)
FIG. 1B depicts a schematic diagram of a prior art bandgap voltage reference circuit using a stacked diode array.

Now referring to FIGS. 1A & 1B, the equation for the output voltage for the two circuits, which is noted as $V_{BG}$, is given in the next two equations:

$$V_{BG}=V_{BE3}+\{\Delta V_{BE}\cdot(R_1/R_2)\} \quad (15)$$

$$V_{BG}=V_{BE3}+\{2\Delta V_{BE}\cdot(R_1/_{R2})\}, \quad (16)$$

Where $V_{BG}$ in Eq. 15 is the bandgap voltage in the circuit in FIG. 1A, and $V_{BG}$ in Eq. 16 is the bandgap voltage in the circuit in FIG. 1B.

The output voltage $V_{BG}$, of FIG. 1A, FIG. 1B, and FIG. 2 are assumed to be all the same value. In addition, the negative temperature coefficient term, $V_{BE3}$, is also assumed to be the same value. Furthermore, the positive temperature coefficient term, $\Delta V_{BE}$, is also assumed to be all the same value. The difference in Eqs. 14, 15, and 16 is in the factors that multiply the positive temperature coefficient term.

Eq. 15 shows a term $R_1/R_2$, whereas Eq. 16 shows a term of $2\cdot(R_1/R_2)$. The factor 2 in Eq. 16 results from the fact that the voltage drop across $R_2$ in FIG. 1B is twice as large as the voltage drop across $R_2$ in FIG. 1A. Therefore, the ratio $R_1/R_2$ of Eq. 16 is half the ratio of Eq. 15. The $(R_1/R_2)$ term increases any non-ideal conditions associated with the generation of the $\Delta V_{BE}$, as well as any noise voltage associated with $R_2$. Thus, the noise source associated with $R_2$ in FIG. 1B and any non-idealities associated with generating the voltage drop across $R_2$ has half the effect as the $R_2$ in FIG. 1A.

Eq. 14 shows a term of $\{(R_1/R_2)/(1-(R_3/R_2))\}$. The voltage drop across $R_2$ in FIG. 2 can be made arbitrarily large by simply adjusting the value of $R_3$. Thus, the noise source associated with $R_2$ in FIG. 2 and any non-idealities associated with generating the voltage drop across $R_2$ in FIG. 2 are greatly reduced when compared to the prior art.

The output noise spectral density of a bandgap voltage reference is normally dominated by the thermal noise generated by the resistors in the circuit. Referring to FIG. 2, the output noise spectral density of the invention is thus given by the following equation:

$$4kt\{R_3\cdot(R_1/R_2)^2)+(R_2\cdot(R_1/R_3)^2)+R_1\}=V_{Noise}^2/\text{Hz}, \quad (17)$$

where k is Boltzmann's constant, and t is the temperature in degrees Kelvin. Comparatively, the output noise spectral density of the prior art circuit in FIG. 1A is given by the following equation:

$$4kt\{(R_1^2/R_2)+R_1\}=V_{Noise}^2/\text{Hz}. \quad (18)$$

The prior art circuit 10 shown in FIG. 1A has two noise sources that must be considered, while the circuit 100 of the present invention shown in FIG. 2 has 3 noise sources that need to be considered; however, the term $(R_1^2/R_2)$ in Eq. 18 is very large in the prior art circuit 10, resulting in much greater output noise than the circuit 100 of the present invention shown in FIG. 2.

As an example, the following are calculations of the different resistor ratios required, as well as the output noise due to the resistors, for a temperature-stabilized output of the prior art circuit 10 of FIG. 1A and the circuit 100 of the present invention shown in FIG. 2.

For a bandgap voltage reference circuit, the temperature stabilized output dc level, where d/dt Vout=0, comes about at an output voltage level on the order of +1.25 Volts. Assume that the $V_{BE}$ term has a voltage equal to 0.6 Volts, and the $\Delta V_{BE}$ term has a voltage of 0.65 Volts. For the prior art circuit 10 shown in FIG. 1A, assume that the transistors $Q_1$ and $Q_2$ have the same magnitude of emitter current flowing through them and that $Q_2$ has eight times the emitter area of $Q_1$. For the circuit 100 in FIG. 2 assume that the transistors $Q_1$ and $Q_3$ have the same magnitude of emitter current flowing through them. Furthermore, assume that $Q_2$ has eight times the emitter area of $Q_3$.

For the prior art circuit 10 of FIG. 1A:

$$0.65\ \text{Volts}=R_1/R_2\cdot V_t\cdot\ln(8), \quad (19)$$

where $V_t$, is defined as the thermal voltage, which is equal to 26 mVolts at room temperature. Therefore, $$R_1/R_2=6 \quad (20)$$

The Output Noise Spectral Density of the Prior Art is given in Eq. 18, and referring to Eq. 19 and substituting for $R_2$ yields as follows:

$$4kt\{6\cdot(R_1^2/R_1)+R_1\}=V_{Noise}^2/Hz \quad (21)$$

and $$48kt\cdot R_1=V_{Noise}^2/Hz. \quad (22)$$

For the circuit 100 of FIG. 2:

$$0.65 \text{ Volts } \{(R_1/R_2)\cdot(1/(1-(R_3/R_2))\cdot V_i\cdot\ln(8)\} \quad (23)$$

$$\text{Set } R_1/R_2=1 \quad (24)$$

$$\text{Therefore, } R_3/R_2=0.917. \quad (25)$$

Using Eqs. 24 and 25 to substitute for $R_2$ and $R_3$ in Eq. 17 yields:

$$4kt\{(0.917\cdot R_1)+(R_1\cdot(1/0.917^2))+R_1\}=V_{Noise}^2/Hz. \quad (26)$$

$$4kt\cdot R_1\{(0.917)+(1/0.917^2)+1\}=V_{Noise}^2/Hz. \quad (27)$$

$$4kt\cdot R_1\{(0.917)+(1/0.917^2)+1\}=V_{Noise}^2/Hz. \quad (28)$$

$$12.43kt\cdot R_1=V_{Noise}^2/Hz. \quad (30)$$

Comparing Eq. 21 to Eq. 30 shows that for the same value of $R_1$, the circuit of the present invention 100 is approximately 3.86 times quieter than the prior art circuit 10 shown in FIG. 1A. Likewise, it can be shown that the circuit 100 of the present invention is approximately 1.93 times quieter than the prior art circuit shown in FIG. 1B.

Figure 4:
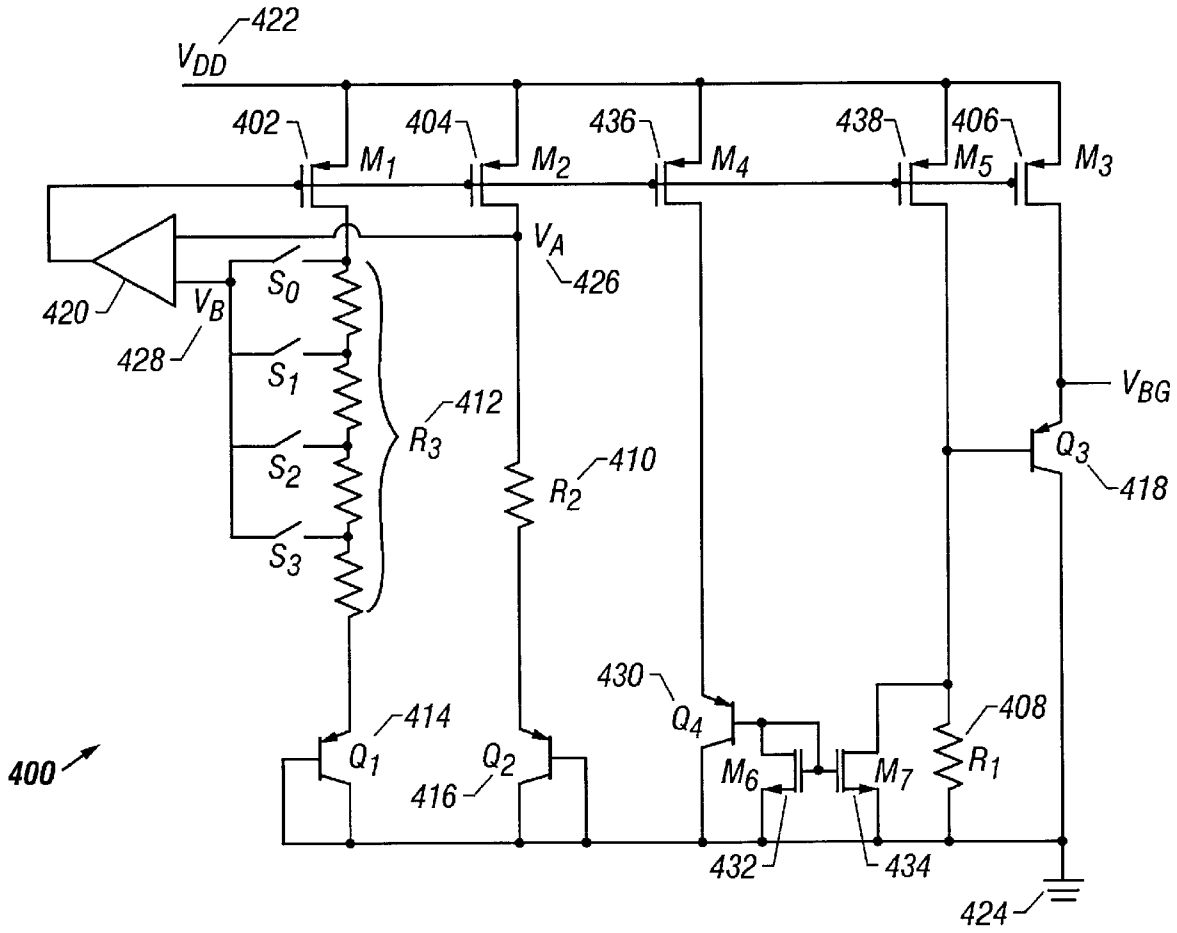
FIG. 4 depicts a schematic diagram of a low output impedance bandgap voltage reference circuit in accordance with a preferred embodiment of the present invention.

A circuit 400 in accordance with the preferred topology of the present invention is shown in FIG. 4. Circuit 400 comprises CMOS transistor 402 ($M_1$), CMOS transistor 404 ($M_2$), CMOS transistor 406 ($M_3$), CMOS transistor 436 ($M_4$), CMOS transistor 438 ($M_5$), CMOS transistor 432 ($M_6$) and CMOS transistor 434 ($M_7$), resistor 408 ($R_1$) and resistor 410 ($R_2$), resistor 412 ($R_3$), bipolar transistor 414 ($Q_1$), bipolar transistor 416 ($Q_2$), bipolar transistor 418 ($Q_3$), and bipolar transistor 430 ($Q_4$), and a feedback operational-amplifier 420. Circuit 400 includes a terminal to a supply voltage 422 ($V_{DD}$), and a reference to ground 424.

Circuit 400 has the following characteristics:

1. The effective value of resistor 412 ($R_3$) can be adjusted by digital control logic. This allows for the adjustment of the feedback voltage measured across resistor 412 ($R_3$). This feature allows for correction of resistor ratio mismatches as well as transistor current source mismatches and offset voltage of operational amplifier 420.
2. The voltage drop across resistor 408 ($R_1$) due to the base current of transistor 414 ($Q_1$) is eliminated.

Referring again to FIG. 4, resistor 412 ($R_3$) is made adjustable, or more precisely, if the voltage difference between the input terminal 428 ($V_B$) of operational amplifier 420 and the emitter terminal of transistor 414 ($Q_1$) is made adjustable, then the resistor ratio term that multiplies the $V_{BE}$ term can be used to adjust for any errors in the resistor ratios due to mismatches arising out of the manufacturing process. In Eq. 14, $R_3$ represents the resistor that is connected between the input terminal 428 ($V_B$) of the operational amplifier 420 and the emitter terminal of transistor 414 ($Q_1$). This resistor value depends upon which of the switch(es) is closed. Furthermore, a salient feature of having the above mentioned adjustment circuit is that not only are mismatches in resistor ratios accounted for but also any matching errors in the currents flowing through transistor 402 ($M_1$) and transistor 404 ($M_2$) can also be corrected. It is noted that the same mismatch corrections can be made if resistor 410 ($R_2$) is made adjustable instead of resistor 412 ($R_3$).

Another significant feature of circuit 400 is that the voltage drop across resistor 408 ($R_1$) due to the base current of transistor 418 ($Q_3$) is eliminated. The base current of transistor 418 ($Q_3$) in circuit 400 has a very large temperature coefficient and is very process dependent. If the base current of transistor 418 ($Q_3$) flows through resistor 408 ($R_1$), then the DC output voltage will have a process dependent voltage error that is not very well controlled. The preferred embodiment of the present invention has circuitry that subtracts the base current of transistor 418 ($Q_3$) before this current flows through resistor 408 ($R_1$).

The base current cancellation is accomplished with transistors 436 ($M_4$), 432 ($M_6$), 434 ($M_7$), and 430 ($Q_4$). The current flowing through transistor 436 ($M_4$) which is the emitter current flowing through transistor 430 ($Q_4$), is related to the emitter current flowing through the output transistor 418 ($Q_3$). The base current of transistor 430 ($Q_4$) flows through transistor 432 ($M_6$). The gate of transistor 434 ($M_7$) is connected to the gate of transistor 432 ($M_6$). The ratio of the current flowing 434 ($M_7$) with respect to transistor 432 ($M_6$) should be the same ratio as the current flowing through transistor 436 ($M_4$) with respect to transistor 406 ($M_3$).

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is therefore intended that the appended claims encompass any such modifications or embodiments.

What is claimed is:

1. A bandgap voltage reference circuit for providing a stable reference output voltage, said bandgap voltage reference circuit comprising:

(a) an operational amplifier having a first input terminal, a second input terminal and an output terminal;

(b) a first resistor having a first terminal and a second terminal, wherein the first terminal of the first resistor is connected to the first input terminal of the operational amplifier;

(c) a second resistor having a first terminal and a second terminal, wherein the first terminal of the second resistor is connected to the second input terminal of the operational amplifier;

(d) a first bipolar transistor having a base terminal, an emitter terminal, and a collector terminal, wherein the base terminal of the first bipolar transistor is connected to the collector terminal of the first bipolar transistor, and wherein the emitter terminal of the first bipolar transistor is connected to the second terminal of the first resistor;

(e) a second bipolar transistor having a base terminal, an emitter terminal, and a collector terminal, wherein the base terminal of said second bipolar transistor is connected to the collector terminal of said second bipolar transistor, and wherein the collector terminal of said second bipolar transistor is connected to the collector terminal of said first bipolar transistor, and wherein the emitter terminal of the second bipolar transistor is connected to the second terminal of the second resistor;

(f) a first CMOS transistor having a gate terminal, a source terminal, and a drain terminal, wherein the gate terminal of the first CMOS transistor is connected to the output terminal of the operational amplifier, and wherein the source terminal of the first CMOS transistor is connected to a voltage supply, and wherein the drain terminal of the first CMOS transistor is connected to the first terminal the operational amplifier;

(g) a second CMOS transistor having a gate terminal, a source terminal, and a drain terminal, wherein the gate terminal of the second CMOS transistor is connected to the output terminal of the operational amplifier, and wherein the source terminal of the second CMOS transistor is connected to the voltage supply, and wherein the drain terminal of the second CMOS transistor is connected to the second terminal the operational amplifier;

(h) a third CMOS transistor having a gate terminal, a source terminal, and a drain terminal, wherein the gate terminal of the third CMOS transistor is connected to the output terminal of the operational amplifier, and wherein the source terminal of the third CMOS transistor is connected to the voltage supply;

(i) a third resistor having a first terminal and a second terminal, wherein the first terminal of the third resistor is connected to the drain terminal of the third CMOS transistor; and (j) a third bipolar transistor having a base terminal, an emitter terminal, and a collector terminal, wherein the base terminal of the third bipolar transistor is connected to the collector terminal of the third bipolar transistor, and wherein the emitter terminal of the third bipolar transistor is connected to the second terminal of the third resistor.

2. The bandgap voltage reference circuit of claim 1, wherein the first bipolar transistor, the second bipolar transistor, and the third bipolar transistor are all PNP bipolar transistors.

3. The bandgap voltage reference circuit of claim 1, wherein the first CMOS transistor, the second CMOS transistor, and the third CMOS transistor are all PMOS transistors.

4. The bandgap voltage reference circuit of claim 1, wherein the first bipolar transistor and the second bipolar transistor are operated at different emitter current densities.

5. A bandgap voltage reference circuit for providing a stable reference output voltage, said bandgap voltage reference circuit comprising:

(a) an operational amplifier having a first input terminal, a second input terminal and an output terminal;

(b) a first resistive element having a first terminal and a second terminal, wherein the first terminal of the first resistive element is connected to the first input terminal of the operational amplifier;

(c) a second resistive element having a first terminal and a second terminal, wherein the first terminal of the second resistive element is connected to the second input terminal of the operational amplifier;

(d) a first bipolar transistor having a base terminal, an emitter terminal, and a collector terminal, wherein the base terminal of the first bipolar transistor is connected to the collector terminal of the first bipolar transistor, and wherein the emitter terminal of the first bipolar transistor is connected to the second terminal of the first resistive element;

(e) a second bipolar transistor having a base terminal, an emitter terminal, and a collector terminal, wherein the base terminal of said second bipolar transistor is connected to the collector terminal of said second bipolar transistor, and wherein the collector terminal of said second bipolar transistor is connected to the collector terminal of said first bipolar transistor, and wherein the emitter terminal of the second bipolar transistor is connected to the second terminal of the second resistive element;

(f) a first CMOS transistor having a gate terminal, a source terminal, and a drain terminal, wherein the gate terminal of the first CMOS transistor is connected to the output terminal of the operational amplifier, and wherein the source terminal of the first CMOS transistor is connected to a voltage supply, and wherein the drain terminal of the first CMOS transistor is connected to the first terminal the operational amplifier;

(g) a second CMOS transistor having a gate terminal, a source terminal, and a drain terminal, wherein the gate terminal of the second CMOS transistor is connected to the output terminal of the operational amplifier, and wherein the source terminal of the second CMOS transistor is connected to the voltage supply, and wherein the drain terminal of the second CMOS transistor is connected to the second terminal the operational amplifier;

(h) a third CMOS transistor having a gate terminal, a source terminal, and a drain terminal, wherein the gate terminal of the third CMOS transistor is connected to the output terminal of the operational amplifier, and wherein the source terminal of the third CMOS transistor is connected to the voltage supply;

(i) a third bipolar transistor having a base terminal, an emitter terminal, and a collector terminal, wherein the base terminal of the third bipolar transistor is connected to the collector terminal of the third bipolar transistor, and wherein the emitter terminal of the third bipolar transistor is connected to the second terminal of the third resistor;

(j) a third resistive element having a first terminal and a second terminal, wherein the first terminal of the third resistive element is connected to the base terminal of the third bipolar transistor, and wherein the second terminal of the third resistive element is connected to a reference to ground;

(k) a fourth CMOS transistor having a gate terminal, a source terminal, and a drain terminal, wherein the gate terminal of the fourth CMOS transistor is connected to the output terminal of the operational amplifier, and wherein the source terminal of the fourth CMOS transistor is connected to the voltage supply; and (l) a fifth CMOS transistor having a gate terminal, a source terminal, and a drain terminal, wherein the gate terminal of the fifth CMOS transistor is connected to the output terminal of the operational amplifier, and wherein the source terminal of the fifth CMOS transistor is connected to the voltage supply, and wherein the drain terminal of the fifth CMOS transistor is connected to the base terminal of the third bipolar transistor.

6. The bandgap voltage reference circuit of claim 5, wherein the second resistive element comprises one or more resistors.

7. The bandgap voltage reference circuit of claim 5, wherein the second resistive element comprises one or more switch elements.

8. The bandgap voltage reference circuit of claim 5, wherein the first bipolar transistor, the second bipolar transistor, and the third bipolar transistor are all PNP bipolar transistors.

9. The bandgap voltage reference circuit of claim 5, wherein the first CMOS transistor, the second CMOS transistor, the third CMOS transistor, the fourth CMOS transistor and the fifth CMOS transistor are all PMOS transistors.

10. The bandgap voltage reference circuit of claim 5, further comprising a fourth bipolar transistor having a base terminal, an emitter terminal, and a collector terminal, wherein the emitter terminal of the fourth bipolar transistor is connected to the drain terminal of the fourth CMOS transistor, and wherein the collector terminal of the fourth bipolar transistor is connected to a reference to ground.

11. The bandgap voltage reference circuit of claim 10, further comprising a sixth CMOS transistor having a gate terminal, a source terminal, and a drain terminal, wherein the gate terminal of the sixth CMOS transistor is connected to the drain terminal of the sixth CMOS transistor, and wherein the drain terminal of the sixth CMOS transistor is connected to the base terminal of the fourth bipolar transistor, and wherein the source terminal of the sixth CMOS transistor is connected to a reference to ground.

12. The bandgap voltage reference circuit of claim 10, further comprising a seventh CMOS transistor having a gate terminal, a source terminal, and a drain terminal, wherein the gate terminal of the seventh CMOS transistor is connected to the gate terminal of the sixth CMOS transistor, and wherein the drain terminal of the seventh CMOS transistor is connected to the first terminal of the third resistive element, and wherein the source terminal of the seventh CMOS transistor is connected to a reference to ground.

13. A bandgap voltage reference circuit for providing a stable reference output voltage, said bandgap voltage reference circuit comprising:

(a) an operational amplifier having a first input terminal, a second input terminal and an output terminal;

(b) a first resistive element having a first terminal and a second terminal, wherein the first terminal of the first resistive element is connected to the first input terminal of the operational amplifier;

(c) a second resistive element having a first terminal and a second terminal, wherein the first terminal of the second resistive element is connected to the second input terminal of the operational amplifier;

(d) a first bipolar transistor having a base terminal, an emitter terminal, and a collector terminal, wherein the base terminal of the first bipolar transistor is connected to the collector terminal of the first bipolar transistor, and wherein the emitter terminal of the first bipolar transistor is connected to the second terminal of the first resistive element;

(e) a second bipolar transistor having a base terminal, an emitter terminal, and a collector terminal, wherein the base terminal of said second bipolar transistor is connected to the collector terminal of said second bipolar transistor, and wherein the collector terminal of said second bipolar transistor is connected to the collector terminal of said first bipolar transistor, and wherein the emitter terminal of the second bipolar transistor is connected to the second terminal of the second resistive element;

(f) a first CMOS transistor having a gate terminal, a source terminal, and a drain terminal, wherein the gate terminal of the first CMOS transistor is connected to the output terminal of the operational amplifier, and wherein the source terminal of the first CMOS transistor is connected to a voltage supply, and wherein the drain terminal of the first CMOS transistor is connected to the first terminal the operational amplifier;

(g) a second CMOS transistor having a gate terminal, a source terminal, and a drain terminal, wherein the gate terminal of the second CMOS transistor is connected to the output terminal of the operational amplifier, and wherein the source terminal of the second CMOS transistor is connected to the voltage supply, and wherein the drain terminal of the second CMOS transistor is connected to the second terminal the operational amplifier;

(h) a third CMOS transistor having a gate terminal, a source terminal, and a drain terminal, wherein the gate terminal of the third CMOS transistor is connected to the output terminal of the operational amplifier, and wherein the source terminal of the third CMOS transistor is connected to the voltage supply;

(i) a third bipolar transistor having a base terminal, an emitter terminal, and a collector terminal, wherein the base terminal of the third bipolar transistor is connected to the collector terminal of the third bipolar transistor, and wherein the emitter terminal of the third bipolar transistor is connected to the second terminal of the third resistor;

(j) a third resistive element having a first terminal and a second terminal, wherein the first terminal of the third resistive element is connected to the base terminal of the third bipolar transistor, and wherein the second terminal of the third resistive element is connected to a reference to ground;

(k) a fourth CMOS transistor having a gate terminal, a source terminal, and a drain terminal, wherein the gate terminal of the fourth CMOS transistor is connected to the output terminal of the operational amplifier, and wherein the source terminal of the fourth CMOS transistor is connected to the voltage supply; and (l) a fifth CMOS transistor having a gate terminal, a source terminal, and a drain terminal, wherein the gate terminal of the fifth CMOS transistor is connected to the output terminal of the operational amplifier, and wherein the source terminal of the fifth CMOS transistor is connected to the voltage supply, and wherein the drain terminal of the fifth CMOS transistor is connected to the base terminal of the third bipolar transistor;

(m) a fourth bipolar transistor having a base terminal, an emitter terminal, and a collector terminal, wherein the emitter terminal of the fourth bipolar transistor is connected to the drain terminal of the fourth CMOS transistor, and wherein the collector terminal of the fourth bipolar transistor is connected to a reference to ground;

(n) a sixth CMOS transistor having a gate terminal, a source terminal, and a drain terminal, wherein the gate terminal of the sixth CMOS transistor is connected to the drain terminal of the sixth CMOS transistor, and wherein the drain terminal of the sixth CMOS transistor is connected to the base terminal of the fourth bipolar transistor, and wherein the source terminal of the sixth CMOS transistor is connected to a reference to ground; and (o) a seventh CMOS transistor having a gate terminal, a source terminal, and a drain terminal, wherein the gate terminal of the seventh CMOS transistor is connected to the gate terminal of the sixth CMOS transistor, and wherein the drain terminal of the seventh CMOS transistor is connected to the first terminal of the third resistive element, and wherein the source terminal of the seventh CMOS transistor is connected to a reference to ground.

14. The bandgap voltage reference circuit of claim 13, wherein the first bipolar transistor, the second bipolar transistor, the third bipolar transistor, and the fourth bipolar transistor are all PNP bipolar transistors.

15. The bandgap voltage reference circuit of claim 13, wherein the first CMOS transistor, the second CMOS transistor, the third CMOS transistor, the fourth CMOS transistor and the fifth CMOS transistor, the sixth CMOS transistor and the seventh CMOS transistor are all PMOS transistors.

16. The bandgap voltage reference circuit of claim 13, wherein the second bipolar transistor operates at a higher emitter current density than the first bipolar transistor.

17. A bandgap voltage generator for providing a stable reference output voltage, said bandgap voltage generator comprising:

(a) a pair of bipolar transistors connected in common collector configuration, wherein said pair of bipolar transistors are operated at different emitter current densities;

(b) resistive elements connected in series with each of the bipolar transistor emitters for establishing a voltage drop;

(c) a pair of CMOS transistors connected in common source configuration and functioning as current sources, wherein the source terminals of the pair of CMOS transistors are connected to a positive supply voltage, and wherein the drain terminals of the pair of CMOS transistors are connected with the resistive elements;

(d) an operational amplifier having a first input terminal, a second input terminal and an output terminal, wherein the output terminal of the operational amplifier is connected to the gate terminals of the pair of CMOS transistors;

(e) a third CMOS transistor operating as a positive temperature coefficient current source, wherein the gate terminal of the third CMOS transistor is connected to the output terminal of the operational amplifier, and wherein the source terminal of the third CMOS transistor is connected to a positive voltage supply;

(f) a fourth CMOS transistor operating as a current source, wherein the gate terminal is connected to the output terminal of the operational amplifier, and wherein the source terminal of the fourth CMOS transistor is connected to the positive voltage supply; and (g) a third bipolar transistor for serving as the output device of the bandgap voltage generator, wherein the base terminal of the third bipolar transistor is connected to the drain terminal of the fourth CMOS transistor.

18. The bandgap voltage generator of claim 17, wherein the bipolar transistors are PNP bipolar transistors.

19. The bandgap voltage generator of claim 17, wherein the CMOS transistors are PMOS transistors.

20. The bandgap voltage generator of claim 17, further comprising a base current compensation circuit, said base current compensation circuit comprising:

(a) a fifth CMOS transistor, wherein the source terminal of the fifth CMOS transistor is connected to the positive voltage supply, and the gate of the fifth CMOS transistor is connected to the output terminal of the operational amplifier;

(b) a fourth bipolar transistor, wherein the emitter terminal of the fourth bipolar transistor is connected to the drain terminal of the fifth CMOS transistor, and wherein the collector terminal of the fourth bipolar transistor is connected to a reference to ground; and (c) a second pair of CMOS transistors connected in common source configuration, wherein said the gate terminals of the second pair of CMOS transistors are connected to the base terminal of the fourth bipolar transistor.

21. The bandgap voltage generator of claim 17, further comprising a feedback voltage adjustment circuit, said feedback voltage adjustment circuit comprising at least one resistor and at least one switch, wherein the feedback voltage adjustment circuit is connected to the second terminal of the operational amplifier.

22. The bandgap voltage generator of claim 21, wherein the at least one switch is controlled by digital logic.

23. A method of providing a bandgap voltage reference, said method comprising the following steps:

(a) operating a pair of bipolar transistors at different emitter current densities;

(b) providing one or more resistive elements in series with the pair of bipolar transistors for establishing a voltage drop;

(c) operating a pair of CMOS transistors as current sources;

(d) configuring an operational amplifier for providing a positive temperature coefficient current source;

(e) providing a control voltage for the positive temperature coefficient current source;

(f) providing a positive temperature coefficient voltage source; and (g) providing a third bipolar transistor as a bandgap voltage output device.

24. The method of claim 23 further comprising the step of offsetting error introduced by the base current of the bandgap voltage output device.

25. The method of claim 23 further comprising the step of adjusting feedback voltage.

26. The method of claim 23 further comprising the step of adjusting the value of the resistance of the one or more resistive elements.

* * * * *